US007677700B2

(12) United States Patent
Tsukuda

(10) Patent No.: US 7,677,700 B2
(45) Date of Patent: Mar. 16, 2010

(54) LIQUID DISCHARGE HEAD

(75) Inventor: Keiichiro Tsukuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 361 days.

(21) Appl. No.: 11/746,165

(22) Filed: May 9, 2007

(65) Prior Publication Data

US 2007/0279448 A1 Dec. 6, 2007

(30) Foreign Application Priority Data

May 30, 2006 (JP) ..... 2006-149903

(51) Int. Cl.
*B41J 2/14* (2006.01)
*B41J 2/16* (2006.01)

(52) U.S. Cl. ..... 347/50; 347/58

(58) Field of Classification Search ..... 347/20, 347/44, 47, 56–59, 61–65, 67, 92–94, 49–50
See application file for complete search history.

(56) References Cited

U.S. PATENT DOCUMENTS 6,257,703 B1 7/2001 Hirisawa et al. ..... 347/50
6,609,782 B2 * 8/2003 Mori ..... 347/50
6,984,025 B2 1/2006 Kaneko et al.
6,988,786 B2 1/2006 Kaneko et al.
7,077,503 B2 7/2006 Kaneko et al.
7,175,255 B2 2/2007 Okito et al.
2006/0238558 A1 10/2006 Hatasa et al.

FOREIGN PATENT DOCUMENTS

JP 10-44420 2/1998

* cited by examiner

*Primary Examiner*—Juanita D Stephens
(74) *Attorney, Agent, or Firm*—Fitzpatrick, Cella, Harper & Scinto

(57) ABSTRACT

A liquid discharge head includes a liquid discharge substrate containing an energy generating element and a liquid discharge port, a flow path member of a resinous material fixed to the liquid discharge substrate and having at least a liquid supply path, a sealing material of a resinous material, a concave part, and a support substrate, wherein a distance $L_1$ from a lateral face of the concave part of the flow path member to an end of the support substrate, a distance $L_2$ from the lateral face of the concave part to a lateral face of the liquid discharge substrate, a linear expansion coefficient $E_1$ of the flow path member and a linear expansion coefficient $E_2$ of the sealing material satisfy a relation: $L_1 \times E_1 > L_2 \times E_2$.

9 Claims, 10 Drawing Sheets

LIQUID DISCHARGE HEAD

BACKGROUND OF THE INVENTION

1. Field of the Invention

The present invention relates to a liquid discharge head for discharging a liquid.

2. Description of the Related Art

An example of the liquid discharge head, popularly used recently is an ink jet head. In general, the ink jet head includes a recording element substrate serving as a liquid discharge substrate for discharging the liquid, and an ink supply system for supplying such recording element substrate with an ink as a liquid.

Also such ink jet head is available in a tank-replaceable type in which an ink tank and an ink jet head are made detachable, and in an ink jet head cartridge type in which an ink jet head part and an ink container part, containing ink, are constructed integrally.

In the following, a conventional ink jet head will be described with reference to FIGS. 9A and 9B. The description will be made on an example of a color cartridge, for executing printing by discharging inks of yellow, magenta and cyan colors.

An ink jet head cartridge 601 illustrated in FIGS. 9A and 9B has a form in which an ink jet head portion, including a recording element substrate 702, and an ink container portion 709, containing ink, are integrally constructed. Within the ink container portion 709, provided is an ink supply path portion for supplying the ink jet head portion with the ink.

The recording element substrate 702 is equipped with a heater, as an element for generating energy for ink discharge, and a wiring for transmitting electric energy supplied from an unillustrated ink jet recording apparatus. On the recording element substrate, provided is a flow path constituting member, including a flow path for supplying the heater with the ink and an ink discharge port for discharging the ink.

In such conventional recording element substrate, the flow path constituting member includes discharge port arrays 703, 704, 705 for discharging inks of three colors of yellow, magenta and cyan.

Besides, the ink jet head 601 is equipped with an electric wiring tape 706, for transmitting electrical signals from the ink jet recording apparatus to the recording element substrate 702. The recording element substrate 702 receives the electrical signals from the ink jet recording apparatus, through external signal input terminals 707.

The recording element substrate 702 is electrically connected, at two end faces of the recording element substrate 702, with the electric wiring tape 706, and such electrical connecting portions are covered by a sealing material 708 and are protected from the ink.

Now a general construction around the recording element substrate 702 of the ink jet head portion will be described with reference to FIG. 10.

FIG. 10 is a cross-sectional view along a line C-C in FIG. 9A. Referring to FIG. 10, a recording element substrate 801 is supported on a support substrate 802. The support substrate 802 includes an ink supply opening 803, for supplying the recording element substrate 801 with the ink, contained in the ink container portion 709 of the ink jet head 601. The support substrate 802 is formed by molding and grinding a material such as alumina or the like, in order to adhere and fix precisely the recording element substrate 801.

Also on the support substrate 802 and around the recording element substrate 801, adhered is a support plate 804 having an aperture in which the recording element substrate 801 can be accommodated. The support plate 804 is formed by a material same as that of the support substrate 802. On the support plate 804, the electric wiring tape 706 is fixed and supported. A gap between a lateral face of the recording element substrate 801 and a lateral face of the support plate 804 is sealed by a sealing material 805 such as a resin. One of the reasons for such sealing is protect the lateral cut face of the recording element substrate 801 from the ink.

In another general example, the support substrate 802 and the support plate 804 illustrated in FIG. 10 are made of a resin. Such construction provides an advantage of inexpensive production, though the precision of adhesion of the recording element substrate 801 is lowered in comparison with the construction utilizing alumina or the like.

As the sealing material 805, a thermosetting resin that can be relatively easily handled in the production process is commonly adopted.

The construction described above with reference to FIG. 10 is disclosed in Japanese Patent Application Laid-Open No. H10-044420.

However, the construction illustrated in FIG. 10 involves the following drawbacks.

At first, there will be described drawbacks encountered when alumina is employed for the support substrate 802 and the support plate 804 illustrated in FIG. 10.

A thermosetting resin is employed for the sealing material 805 for sealing the periphery of the recording element substrate 801. Therefore, the sealing material 805 has a linear expansion coefficient generally higher than in the recording element substrate 801 utilizing a silicon substrate or in the support substrate 802 and the support plate 804 utilizing alumina. The sealing material 805 of the thermosetting resin is generally cured at a high temperature such as 100° C. or higher, and generates a curing shrinkage when the resin cured at the high temperature returns to the normal temperature. Also, the resin further deforms in the shrinking direction, for example when left in a low-temperature environment. In such case, the recording element substrate 801, the support substrate 802 and the support plate 804 also shrink, but a tensile stress is generated in a direction indicated by arrows in FIG. 10, because of the difference in the linear expansion coefficient from that of the sealing material 805. As a result, a defect such as a cracking of the recording element substrate 801 may be generated by such stress.

This phenomenon becomes a trouble in producing the recording element substrate of a lowered strength, which results for example by minimizing the size of the recording element substrate for the purpose of cost reduction.

Next, there will be described other drawbacks encountered with the support substrate 802 and the support plate 804 illustrated in FIG. 10.

The recording element substrate 801 is generally prepared with a silicon substrate. For this reason, the support substrate 802 formed by a resin, on which the recording element substrate 801 is adhered and fixed, has a linear expansion coefficient significantly larger than that of the recording element substrate 801. Therefore, in the case that the recording element substrate 801 is exposed to a temperature environment, extremely different from the temperature at which the recording element substrate 801 was fixed to the support substrate 802 of resinous material, the recording element substrate 801 is subjected to a deformation stress of the resin and may cause defects such as a deformation or a breakage.

In order to solve this problem, it is conceivable to form a beam structure in the ink supply opening 803 of the support substrate 802, thereby increasing the rigidity of the support substrate 802. In such construction, however, when the recording element substrate 801 is adhered and fixed to the support substrate 802 by an adhesive material, an excessive adhesive material may flow out along the beam and may enter the ink supply opening 803 provided in the recording element substrate 801. In a worst situation, an ink discharge port provided on the recording element substrate 801 may be clogged.

SUMMARY OF THE INVENTION

An object of the present invention is to provide an inexpensive and highly reliable liquid discharge head, that is free from a cracking in a substrate, even when a periphery of a liquid discharge substrate, employed in the liquid discharge head, is sealed with a thermosetting resin.

Another object of the present invention is to provide a liquid discharge head including a liquid discharge substrate containing an energy generating element for generating liquid-discharging energy and a liquid discharge port, a flow path member of a resinous material fixed to the liquid discharge substrate and having at least a liquid supply path for supplying the liquid discharge substrate with a liquid, a sealing material of a resinous material for sealing a periphery of the liquid discharge substrate, a concave part formed on the flow path member for accommodating the liquid discharge substrate, and a support substrate which is adhered and fixed to a bottom face of the concave part, which supports and is adhered to a surface of the liquid discharge substrate at a side opposite to the liquid discharge port and which is prepared with a material having a Young's modulus higher than that of at least the liquid discharge substrate and having a linear expansion coefficient lower than that of the flow path member, wherein a distance $L_1$ from a lateral face of the concave part of the flow path member to an end of the support substrate, a distance $L_2$ from the lateral face of the concave part to a lateral face of the liquid discharge substrate, a linear expansion coefficient $E_1$ of the flow path member and a linear expansion coefficient $E_2$ of the sealing material satisfy a relation: $L_1 \times E_1 > L_2 \times E_2$.

Further features of the present invention will become apparent from the following description of exemplary embodiments with reference to the attached drawings.

DESCRIPTION OF THE EMBODIMENTS

In the following, exemplary embodiments of the present invention will be described with reference to the accompanying drawings.

First Exemplary Embodiment

Figure 1:
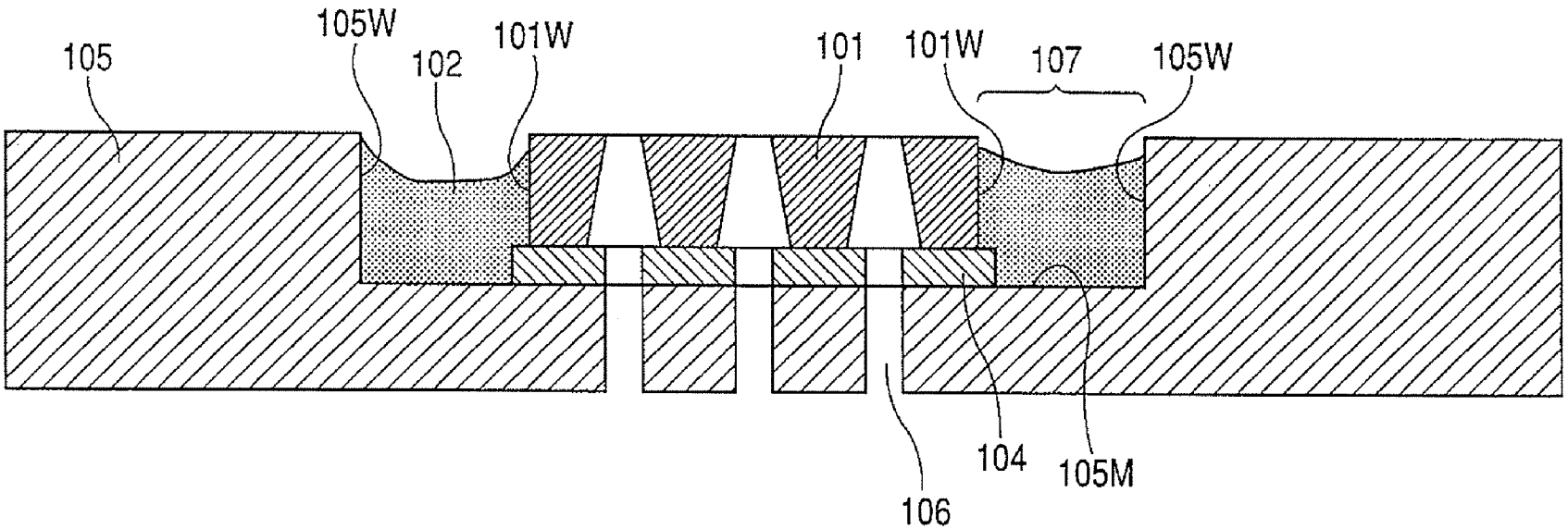
FIG. 1 is a schematic partial cross-sectional view illustrating a recording element substrate of an ink jet head in a first exemplary embodiment of the present invention.
Figure 2:
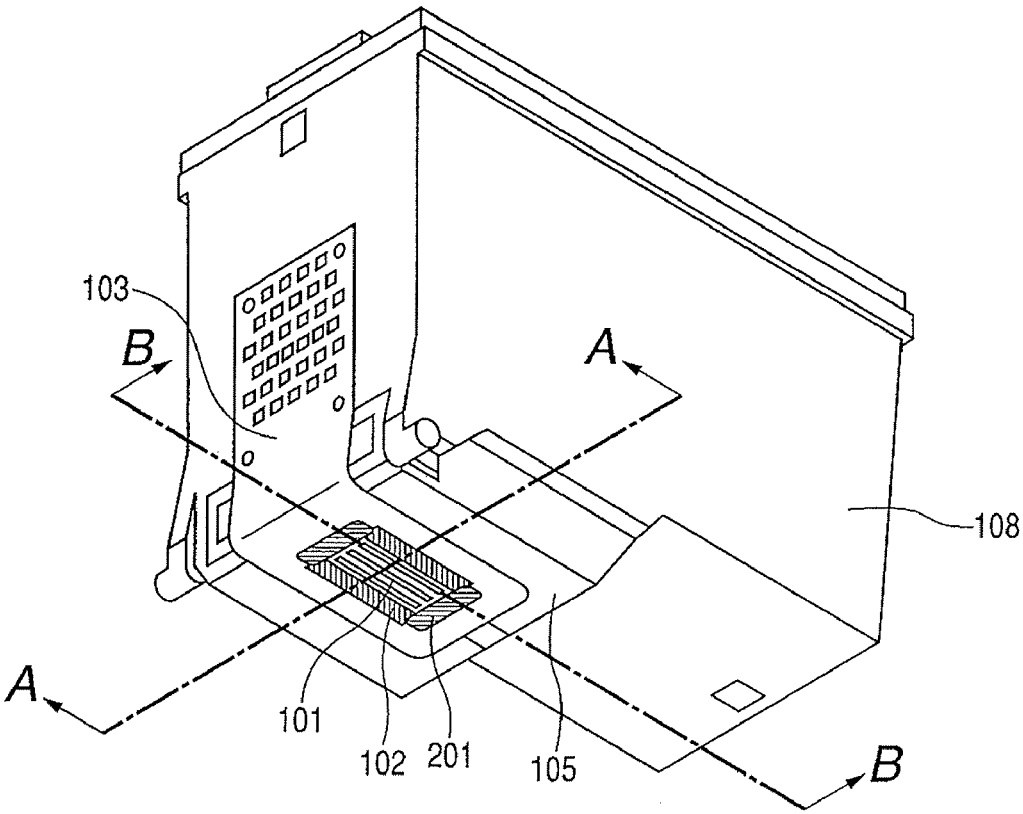
FIG. 2 is a perspective view of an ink jet head cartridge in an exemplary embodiment of the present invention.

FIG. 1 is a schematic partial cross-sectional view illustrating a recording element substrate 101 of an ink jet head, in a first exemplary embodiment of the present invention, and illustrates a cross section along a line A-A in FIG. 2. FIG. 2 is a perspective view of an ink jet head cartridge 100 of the present exemplary embodiment. In FIG. 2, a direction along a line B-B is parallel to a direction of array of ink discharge ports, constituting a discharge port array of the ink jet head. Also a direction along the line A-A in FIG. 2 is perpendicular to the line B-B.

The ink jet head cartridge 100 of the present exemplary embodiment includes a flow path member 105, which supports the recording element substrate 101 across a support substrate 104, and which includes an ink flow path for supplying the recording element substrate 101 with an ink from an ink container portion 108 containing the ink. The recording element substrate 101 is prepared with a silicon substrate and is adhered and fixed onto the support substrate 104 which is provided in a concave part on the surface of the flow path member 105. A gap 107 in the periphery of the recording element substrate 101 is sealed by a sealing material 102 of a thermosetting epoxy resin, filled in the interior of the concave part of the flow path member 105. In addition, the recording element substrate 101 is electrically connected with an electric wiring tape 103, for transmitting an electric power and an electrical signal from the unillustrated ink jet recording apparatus to the recording element substrate 101. A portion for such electrical connection is disposed in the vicinity of an end edge of the recording element substrate 101, parallel to the line A-A in FIG. 2 and is sealed by an electrode sealing material 201.

The recording element substrate 101 is provided, though not illustrated, with a plurality of electro-thermal converting elements and a flow path constituting member, on a silicon substrate. This flow path constituting member forms plural ink flow paths, each including a liquid chamber surrounding each electro-thermal converting element, and plural ink discharge ports, each communicating with each liquid chamber. Furthermore, the flow path constituting member includes a common liquid chamber which is common to the plural ink flow paths, and the silicon substrate is penetrated by an ink supply opening 109, having an oblong rectangular opening shape, for supplying the common liquid chamber with the ink. These components, except for the ink supply opening 109, are schematically illustrated in FIG. 1. The opening shape of the ink supply opening 109 is made oblong in a direction along the line B-B in FIG. 2.

In the following, the construction of the ink jet head of the present exemplary embodiment will be described in detail. In the present exemplary embodiment, a construction excluding the ink container portion 108 from the ink jet head cartridge 100 will be called an ink jet head.

Referring to FIG. 1, the recording element substrate 101 is adhered and fixed, across the support substrate 104, on a mounting surface 105M which is a bottom surface of a concave part, formed on the surface of the flow path member 105. The flow path member 105 includes an ink flow path 106 for supplying the recording element substrate 101 with the ink. The support substrate 104 is formed by grinding sintered alumina.

In the present exemplary embodiment, the ink flow path 106 of the flow path member 105 is provided in the silicon substrate constituting the recording element substrate 101, so as to correspond, in position and shape, to the ink supply opening (penetrating hole) 109. Also the support substrate 104 includes an ink flow path 110, which connects the ink flow path 106 of the flow path member 105 and the ink supply opening 109 of the recording element substrate 101.

In the present exemplary embodiment, the flow path member 105 is formed with a resinous material same as that of a casing constituting the ink container portion 108 of the ink jet head cartridge 100, by injection molding utilizing a mold. In the present exemplary embodiment, the flow path member 105 and the casing of the ink container portion 108 were formed by a resin Noryl (trade name) of GE Plastics Inc.

Also the support substrate 104 made of alumina serves as a supporting substrate for securing a precision for adhering the recording element substrate 101. In case of a construction that the recording element substrate 101 made of silicon is directly adhered to the flow path member 105 made of a resin, when the ink jet head is subjected to a large temperature change, the recording element substrate 101 may be destructed by a deformation stress, resulting from a difference in the linear expansion coefficient between the two. In order to avoid such situation, the support substrate 104 made of alumina is disposed, as a kind of protecting member, between the flow path member 105 made of a resin and the recording element substrate 101 made of silicon. The support substrate 104 particularly plays an important role in case of compactifying the recording element substrate 101 for the purpose of cost reduction (such compactification generating a portion of low strength). The support substrate 104 will be described later in more details.

As illustrated in FIG. 1, the flow path member 105 has a concave part on a surface for mounting the recording element substrate 101 and the support substrate 104. On the bottom face of the concave part (mounting surface 105M), the recording element substrate 101 is fixed across the support substrate 104. Also a sealing material 102 is filled in a gap 107, between a lateral face 101W of the recording element substrate 101 and an internal lateral face 105W of the concave part formed on the flow path member 105. The sealing material 102 is filled in the gap 107, in order to protect a cut surface of the silicon substrate (namely lateral face 101W of the recording element substrate 101) from the ink. The sealing material 102 also extends to the lower side of the electrode sealing material 201 illustrated in FIG. 2, thus protecting also an electrical connecting portion between the recording element substrate 101 and the electrical wiring tape 103.

In the present exemplary embodiment, the sealing material 102, sealing the periphery of the recording element substrate 101, is cured, after the coating of the sealing material 102, by standing in an oven of 100° C. for 1 hour or longer. The curing conditions of the sealing material are selected in consideration of an ink resistance and an adhesion strength, and are not limited to such temperature and time.

Figure 3:
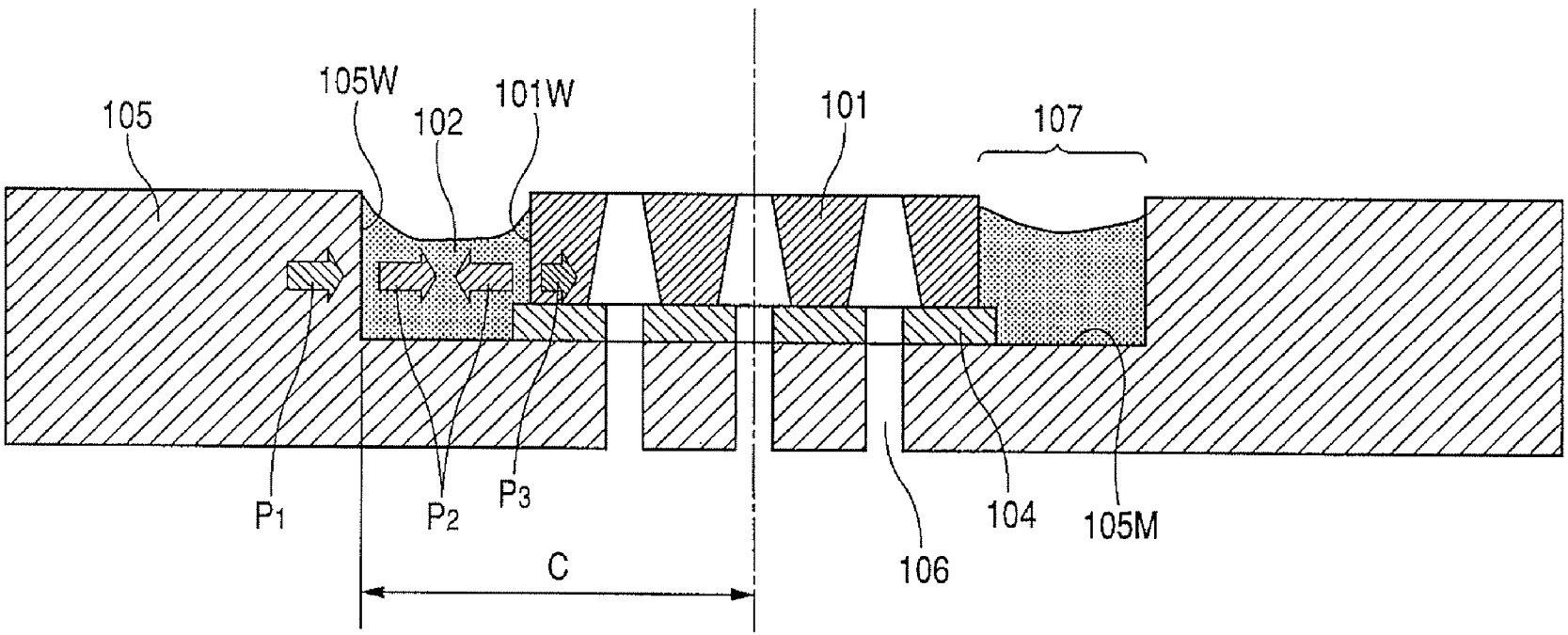
FIG. 3 is a schematic partial cross-sectional view illustrating a recording element substrate of an ink jet head in the first exemplary embodiment of the present invention.

In case of such construction, a stress applied to the lateral face 101W of the recording element substrate 101 under a temperature change will be briefly described with reference to FIG. 3. FIG. 3 illustrates a cross-section along a line A-A in FIG. 2.

At first, the support substrate 104 made of alumina is adhered with an adhesive material (not illustrated) to the flow path member 105 made of a resin. Then the recording element substrate 101 is adhered with an adhesive material (not illustrated) to the support substrate 104 made of alumina. However the order of adhesions is not restricted to that described above. Then the sealing material 102 is made to flow into the gap 107 between the recording element substrate 101 and the flow path member 105. Subsequently, the assembly is placed in an oven of 100° C. in order to cure the sealing material 102. In response, the components constituting the ink jet head show expansions by the temperature change from the room temperature to 100° C. In this state, the expanding rates of the components are different respectively corresponding to the linear expansion coefficients thereof.

The linear expansion coefficients of the materials employed in the present exemplary embodiment are as follows. The recording element substrate 101 made of silicon has a linear expansion coefficient of about 3 ppm, while the support substrate 104 made of alumina has a linear expansion coefficient of about 7 ppm, and the flow path member 105 made of Noryl and the sealing material 102 made of thermosetting epoxy resin have a linear expansion coefficient of from about 20 to 60 ppm. Therefore, in a case where the recording element substrate 101 has a width (length in the lateral direction in the drawing) of 4 mm in a state prior to the curing of the sealing material 102 and at the room temperature of 25° C., the width of the recording element substrate 101 expands by 0.9 μm by a linear expansion in a state where the sealing material 102 is cured at 100° C. On the other hand, in a case where a distance C (distance from the center of the width of the recording element substrate 101 to the internal lateral face 105W of the concave part in the flow path member 105) is 3 mm at the room temperature of 25° C., and a linear expansion coefficient of 40 ppm for the flow path member 105, the distance C increases by about 9 μm by the temperature elevation to 100° C. The adhesive material and the sealing material 102, fixing the recording element substrate 101, the support substrate 104 and the flow path member 105, are cured in such state. Stated differently, the components are fixed in such expanded state. When the ink jet head is taken out from the oven, each component tends to return to the original dimension as the ambient temperature of the ink jet head is lowered to the room temperature. As a result, the recording element substrate 101 is subjected to a shrinking displacement of the flow path member 105 and a shrinking displacement of the sealing material 102. For a linear expansion coefficient of the sealing material 102 of 40 ppm and a width of the sealing material of 1 mm present in the gap 107, the sealing material 102 shrinks by 3 μm.

With respect to a direction perpendicular to the lateral face 101W of the recording element substrate 101 (namely in a direction of a force applied by the flow path member 105 on the lateral face thereof), there exists at first a shrinking force of the flow path member 105 which tends to shrink by 9 μm in a direction indicated by an arrow P1 (pressing direction on the lateral face 101W of the recording element substrate 101). Also with respect to a direction of pulling the lateral face 101W of the recording element substrate 101, there exist two forces, which are a shrinking force of the sealing material 102 in directions indicated by arrows P2, and a shrinking force of the recording element substrate 101 in a direction indicated by an arrow P3. In such construction, therefore, the internal lateral face 105W of the concave part of the flow path member 105 tends to press and displace, across the sealing material 102, the lateral face 101W of the recording element substrate 101 along the mounting surface 105M, by an amount of 9−3−0.45=5.55 μm. Stated differently, the lateral face 101W of the recording element substrate 101 is subjected to a compression stress, across the sealing material 102.

On the other hand, the behavior becomes different in a construction in which the internal lateral face 105W of the flow path member does not move in the shrinking direction (for example a construction in which the flow path member 105 in the vicinity of the internal lateral face 105W is fixed to and supported by a rigid member). In such case, since the internal lateral face 105W of the concave part of the flow path member does not move, all the shrinking force of the sealing material 102 acts to pull the lateral face 101W of the recording element substrate 101. In such construction, defects have been observed such as a cracking of the recording element substrate 101. In a confirmation undertaken by the present inventor, the recording element substrate 101 of a shape and a size (for example a lateral dimension of 4 mm, a longitudinal dimension of 10 mm and a thickness of 0.6 mm) was destructed by a force of about 1 kgf, in a direction of pulling the lateral face of the substrate. However, it was not destructed by a force of about 3 kgf in the pressing direction. In the present invention, it is desirable, at least in a direction along the line A-A in FIG. 2, that an amount of expansion/shrinkage by temperature change of the internal lateral face 105W of the concave part of the flow path member 105, opposed to the lateral face 101W of the recording element substrate 101, is larger than an amount of expansion/shrinkage of the sealing material 102. In such case, when the temperature is lowered from 100° C. to the room temperature, the shrink amount in the distance between the internal lateral face 105W of the concave part of the flow path member 105 and the lateral face 101W of the recording element substrate 101 becomes larger than the shrink amount of the sealing material 102 present in the gap 107. Therefore a force in a pressing direction is applied on the lateral face 101W of the recording element substrate 101.

Figure 4:
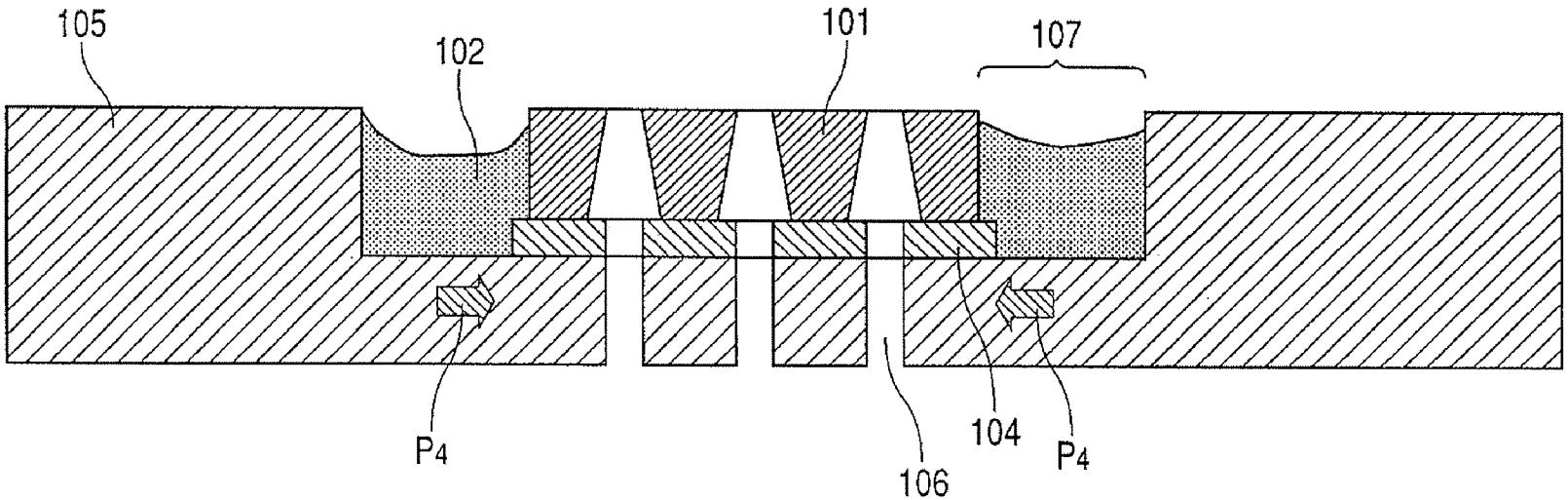
FIG. 4 is a schematic partial cross-sectional view illustrating a recording element substrate of an ink jet head in the first exemplary embodiment of the present invention.

Also referring to FIG. 4 illustrating a cross section along the line A-A in FIG. 2, the flow path member 105 also causes, in a direction along the bottom surface of the recording element substrate 101 (direction substantially same as the direction along the mounting face 105M), a shrinkage as indicated by arrows P4 in FIG. 4.

In the case that the recording element substrate 101 is directly adhered and fixed to the flow path member 105, a deforming force of the flow path member 105 (shrinking force indicated by the arrows P4 in FIG. 4) is applied directly on the recording element substrate 101. As a result, the recording element substrate 101 may be deformed, whereby the landing position of the ink discharged from the recording element substrate 101 may be displaced. This defect is liable to appear particularly when the thickness of the recording element substrate 101 is made small. This is because, due to the presence of the ink supply opening in the recording element substrate, a smaller thickness thereof reduces the thickness (height) of the lateral wall of the ink supply opening, whereby the rigidity of such lateral wall is lowered.

Therefore, the present exemplary embodiment has a construction that the recording element substrate 101 is adhered to the flow path member 105 across the support substrate 104 made of alumina, which has a Young's modulus higher than that in silicon constituting the recording element substrate 101. Thus, regardless of the change in the ambient temperature, the flow path member 105 fixed to the support substrate 104 can be regarded as substantially free from a displacement (deformation) such as expansion or shrinkage. For example, a length of the portion of the flow path member 105, fixed to the support substrate 104 as indicated by an arrow D in FIG. 5, can be considered as scarcely variable.

The Young's modulus of the components employed in the present exemplary embodiment is about 170 Gpa in silicon, and 320 Gpa in alumina, which is about a double of Young's modulus in the silicon substrate. Since alumina has a high Young's modulus, it is unnecessary to increase the thickness of the silicon substrate of the recording element substrate 101 and it is possible to reduce the thickness of the support substrate 104 made of alumina. It is therefore possible to improve a de-bubbling property in the ink supply path without unnecessarily extending the length thereof, and to suppress the deformation in the recording element substrate 101. In such construction, the support substrate 104 preferably has a projected area similar to that of the recording element substrate 101, in order to relax the stress applied from the sealing material 102 to the recording element substrate 101, and also in consideration of the cost.

Figure 5:
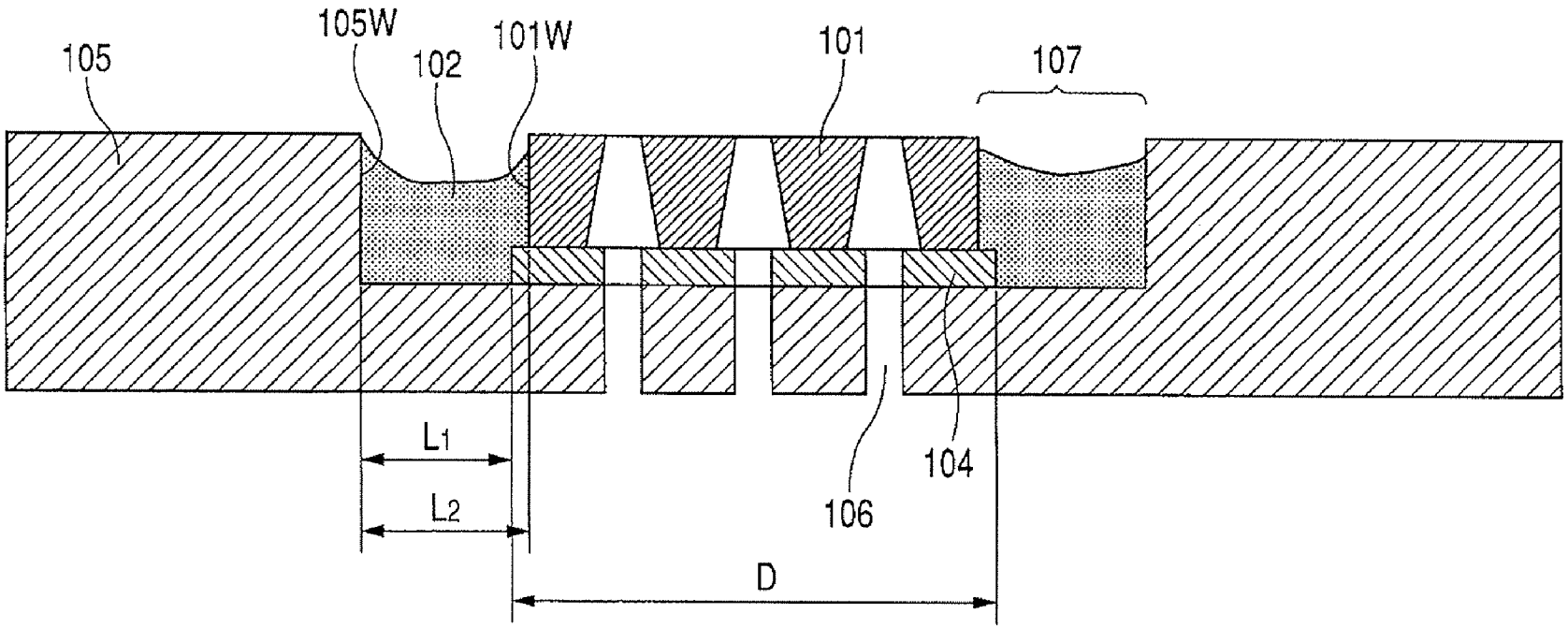
FIG. 5 is a schematic partial cross-sectional view illustrating a relationship of displacements in the sealing material for the recording element substrate and the flow path member, caused by linear expansion, in an ink jet head in the first exemplary embodiment of the present invention.

FIG. 5 is a schematic partial cross sectional view illustrating a displacement relationship by linear expansion in the sealing material and the flow path member, in the recording element substrate of the ink jet head of the first exemplary embodiment of the present invention.

The reliability of the ink jet head can be further improved by adding a following construction to the construction described above.

At first, across a support substrate 104 having an area somewhat larger than the bottom surface of a recording element substrate 101, the recording element substrate 101 and the flow path member 105 are fixed on respective surfaces of such support substrate 104. Now a distance from the internal lateral face 105W of the concave part in the flow path member 105 to an end of the support substrate 104 is taken as $L_1$, and a distance from the internal lateral face 105W of the concave part to the lateral face 101W of the recording element substrate 101 is taken as $L_2$. When the length D in FIG. 5 is regarded as scarcely variable as describe above, a length $L_1$ in the flow path member 105 is subjected to the influence of the ambient temperature change. In the present exemplary embodiment, materials were selected so as to satisfy a relation $L_1 \times E_1 > L_2 \times E_2$ wherein $E_1$ is a linear expansion coefficient of the flow path member 105 made of a resin and $E_2$ is a linear expansion coefficient of the sealing material. The value A was selected as from 0.8 to 0.9 mm, B as 1 mm, and $E_1$ and $E_2$ were regulated so as to satisfy the foregoing relation, by mixing an inorganic substance such as a filler in the flow path member 105 and the sealing material, both being made of resins. In this manner, at the cooling to the room temperature after thermal curing of the sealing material, a pressing force (compression stress) could be applied to the lateral face 101W of the recording element substrate 101, thereby preventing a destruction of the recording element substrate 101 by being pulled by the sealing material. Also within an ambient temperature range in which the liquid discharge head can execute a normal liquid discharge, the lateral face of the recording element substrate 101 is subjected to a slight compression stress (within an extent that the recording element substrate 101 is not destructed) from the flow path member 105 and the sealing material 102.

Second Exemplary Embodiment

Now a second exemplary embodiment will be described with reference to FIG. 6, in which components same as those in the foregoing embodiment will be represented by same symbols.

Figure 6:
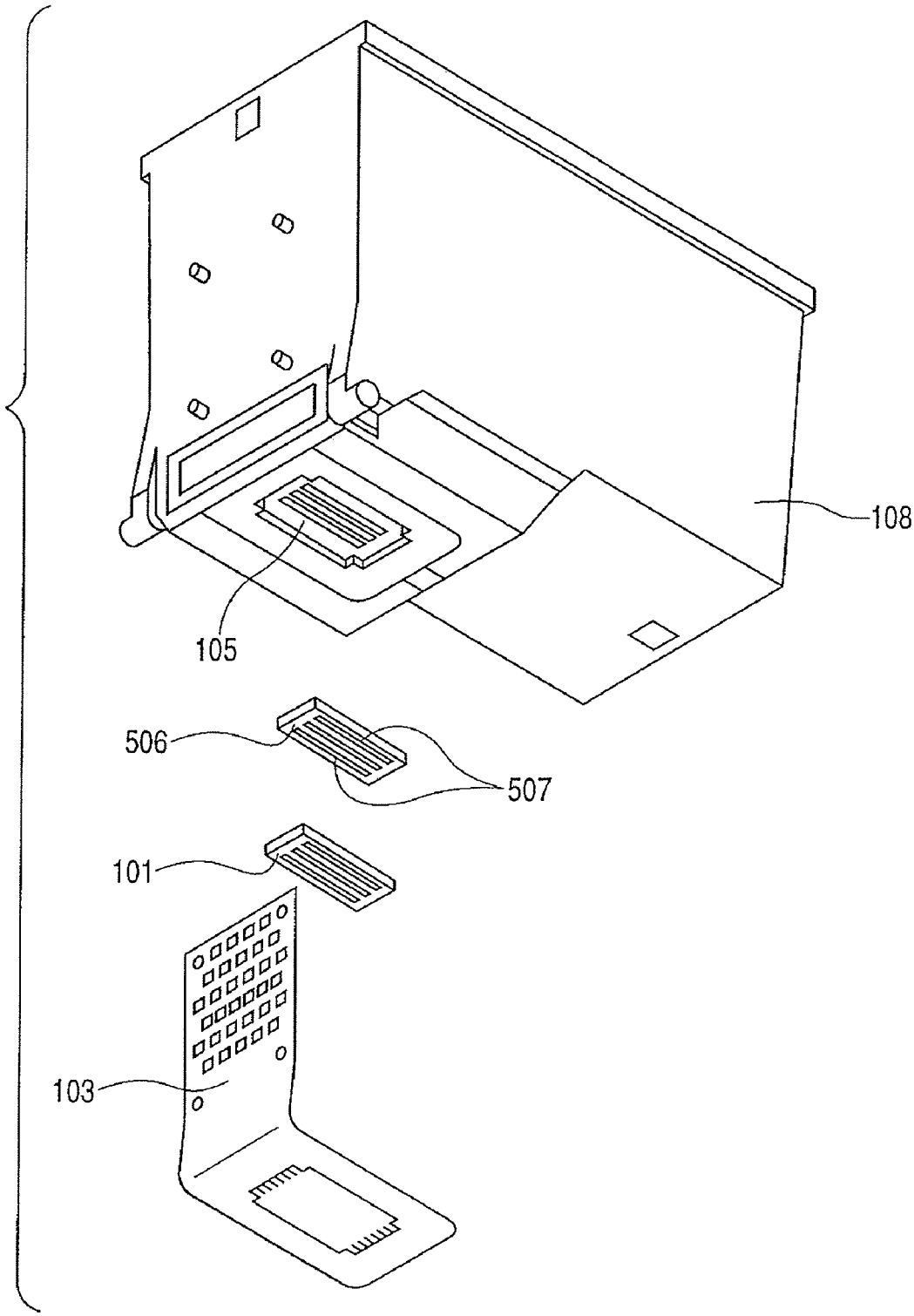
FIG. 6 is an exploded perspective view of an ink jet head in the second exemplary embodiment of the present invention.

Referring to FIG. 6, the recording element substrate 101 is adhered and fixed, across a support substrate 506 made of alumina, by an adhesive material to the flow path member 105 made of a resin. In the present exemplary embodiment, a case 108 is an ink container incorporating an ink absorbent member (not illustrated) impregnated with ink, and is prepared by a resin molding integrally with the flow path member 105. An electrical wiring tape 103 is electrically connected to the recording element substrate 101, and transmits an electrical signal from the ink jet recording apparatus (not illustrated) to the recording element substrate 101.

The recording element substrate 101 has a construction including discharge port arrays, for discharging ink of three colors of yellow, magenta and cyan, in this order, and including three corresponding ink supply openings. The ink supply opening has an oblong rectangular shape, as described in the first exemplary embodiment. Each of the support substrate 506 and the flow path member 105 has three ink supply paths (penetrating holes) corresponding to the ink supply openings in the recording element substrate 101.

Further in the present exemplary embodiment, among the three ink supply paths in the flow path member 105 (cf. FIGS. 7A and 7B), the cross section can be made wider for reducing the flow path resistance in cyan (C) and yellow (Y) on both sides, but is difficult to make wider in magenta (M) at the center. Therefore, for magenta (M) at the center, the cross section of the flow path has to be secured as wide as possible in the ink supply path of the support substrate 506. For this reason, among the three ink supply paths in the support substrate 506, the center ink supply path does not have a beam, while at least a beam 507 is formed only in each of the ink supply paths at both sides (C and Y). Since the stress, applied on the recording element substrate because of the difference in the linear expansion coefficients of the members as described in the first exemplary embodiment, is small in a central portion of the substrate, the above-described construction allows to sufficiently achieve an improvement in the rigidity.

Now there will be given a description, with reference to FIGS. 7A and 7B, on the beam 507 when the recording element substrate 101, the support substrate 506 and the flow path member 105 are adhered and fixed by the adhesive material.

Figure 7A:
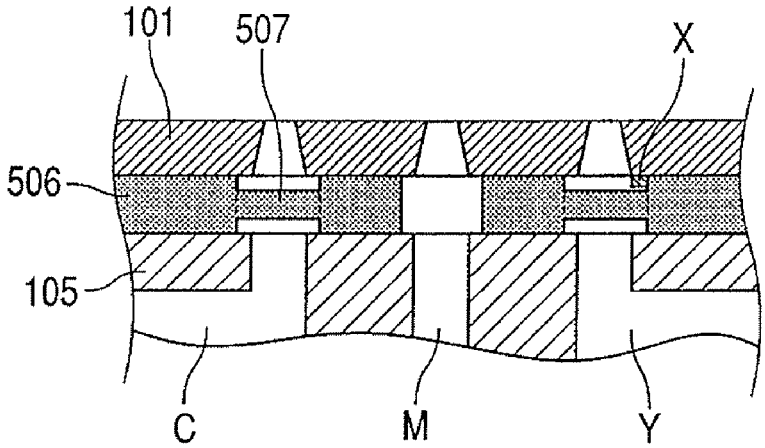
FIGS. 7A and 7B are schematic partial cross-sectional views illustrating the construction of an ink supply path in a recording element substrate, a support substrate and a flow path member in an ink jet head in a second exemplary embodiment of the present invention.

FIG. 7A is a cross-sectional view illustrating the construction of the present exemplary embodiment. FIG. 7B is a cross-sectional view of a construction, for the purpose of comparison with FIG. 7A, in which a beam 507 provided in the support substrate 506 is not recessed from both surfaces of the support substrate. Incidentally, FIGS. 7A and 7B illustrate a cross-section of the ink jet head, along a shorter direction (direction A-A in FIG. 2) of the ink supply opening of the recording element substrate.

Figure 7B:
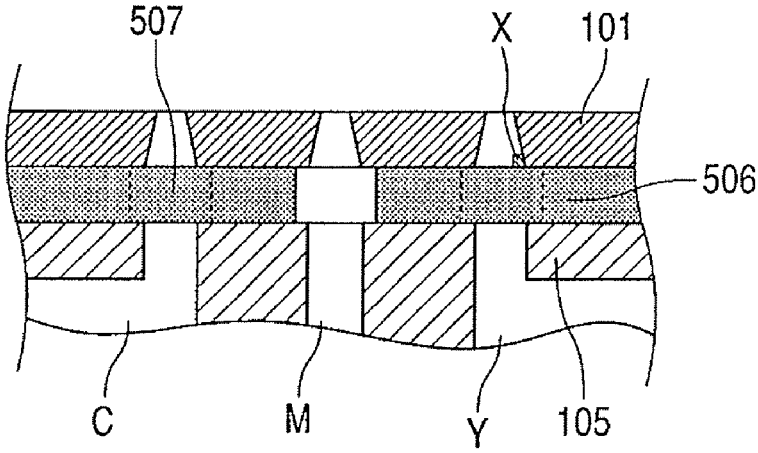

In each of FIGS. 7A and 7B, the recording element substrate 101 is adhered and fixed, by an adhesive material, to the support substrate 506. An overflowing portion of the excessive adhesive material is indicated by X in FIGS. 7A and 7B.

In the construction illustrated in FIG. 7B, the overflowing adhesive material X is positioned inside the ink supply opening, provided in the recording element substrate 101. Such state may block the ink flow to be supplied to the recording element substrate 101. Also in the case that the adhesive material has a very low viscosity prior to curing, the adhesive material may move in the ink supply opening of the recording element substrate 101 by a capillary force, and may clog, in a worst case, the ink discharge port (not illustrated) for discharging the ink.

In the present exemplary embodiment, therefore, as illustrated in FIG. 7A, the upper and lower faces of the beam 507 provided on the support substrate 506 are recessed from the upper and lower adhesion surfaces of the support substrate 506 to be adhered with the recording element substrate and the flow path member 105, in a concave manner toward the internal side of the ink supply opening. In such construction, as illustrated in FIG. 7A, the overflowing adhesive material X is retained between the recording element substrate 101 and the support substrate 506, thereby enabling to avoid the drawbacks mentioned above. Though not illustrated, a similar situation applies in the adhesion of the support substrate 506 and the flow path member 105, and the construction illustrated in FIG. 7A allows to provide an ink jet head of a high reliability.

In the present exemplary embodiment, the beam 507 provided in the ink supply opening of the support substrate 506 is shaped in a concave form toward the internal side of the ink supply opening on both of the surface adhered to the recording element substrate and the surface adhered to the flow path member. However the concave form may be provided on one side only, depending on the property of the adhesive material to be employed on each side. In general, an intrusion of the adhesive material into the ink supply opening of the recording element substrate 101 induces an intrusion of the adhesive material into the discharge port of the recording element substrate 101, thus resulting in a discharge failure. For this reason, it is preferable to form the concave form at the adhesion surface of the recording element substrate 101 and the support substrate 506.

As described above, in the ink jet head of the above-described exemplary embodiments, the recording element substrate 101 is adhered and fixed, across a support substrate having a Young's modulus higher than that of the recording element substrate 101, to the flow path member 105 made of a resin and having an ink supply path. Such construction enables to provide an ink jet head having a high reliability to a temperature change even with an inexpensive structure.

Also in case of employing an electric wiring member 103 for transmitting electrical signals from the ink jet recording apparatus to the recording element substrate 101, the electric wiring member 103 is adhered and fixed to the support substrate. This construction enables to prevent the electric connecting portion between the electric wiring member 103 and the recording element substrate 101 from being destructed by the thermal dimensional change in the member on which the electric wiring member 103 is adhered.

Other Embodiments

Figure 8:
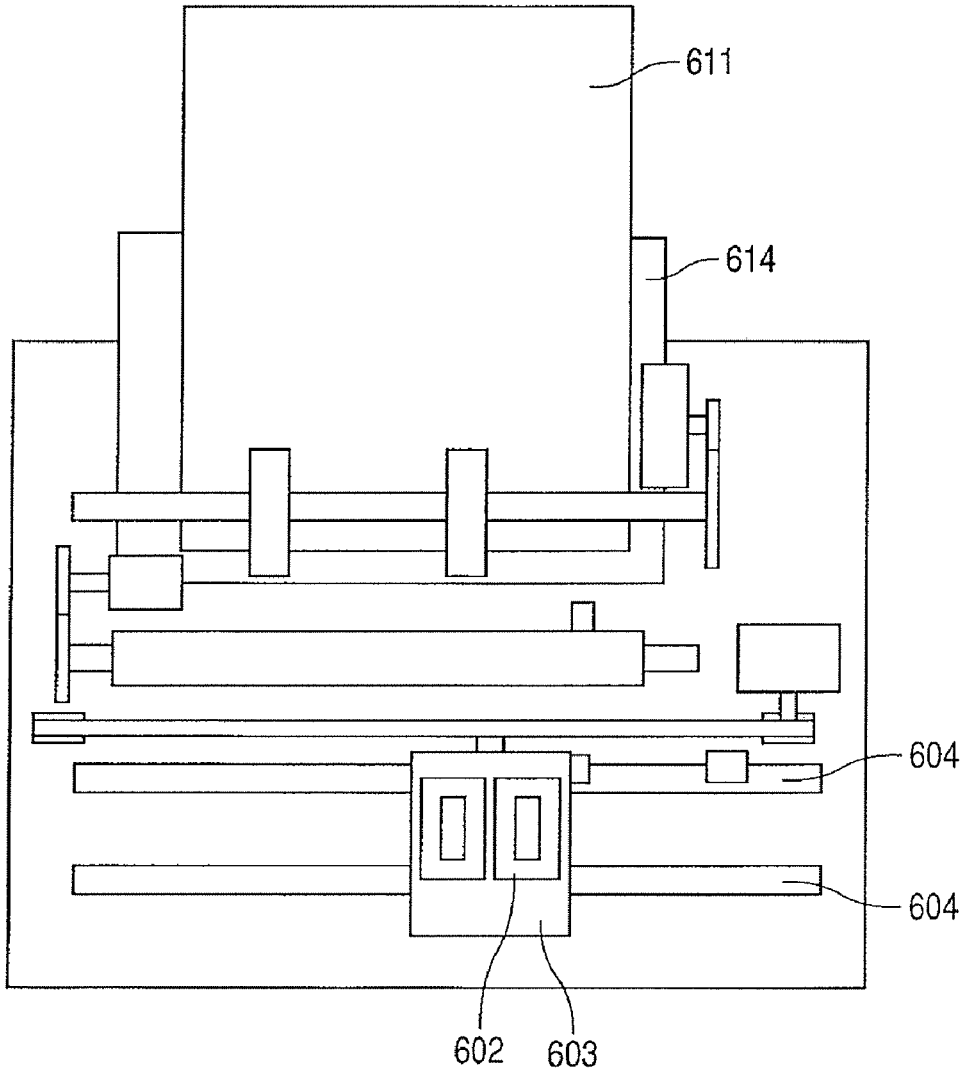
FIG. 8 is a schematic view of an ink jet recording apparatus equipped with an ink jet head cartridge of the present invention.
Figure 9B:
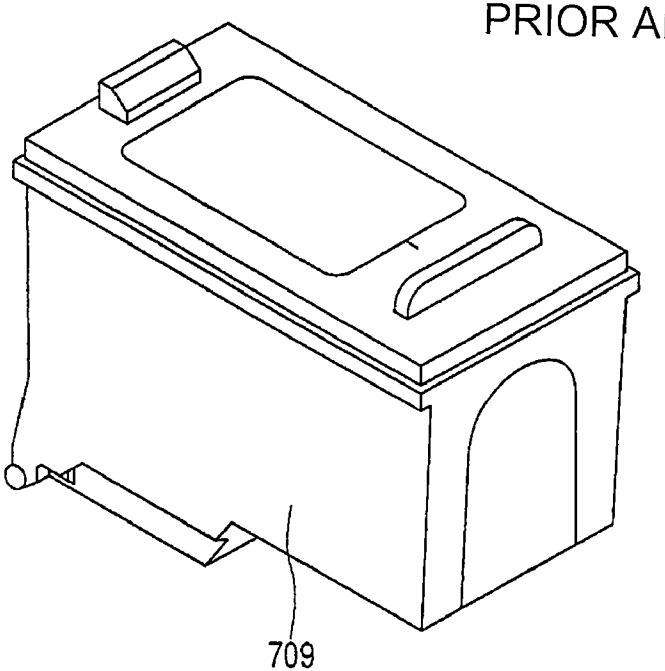
FIG. 9B PRIOR ART
FIGS. 9A and 9B are perspective views of a conventional ordinary ink jet head cartridge.
Figure 9A:
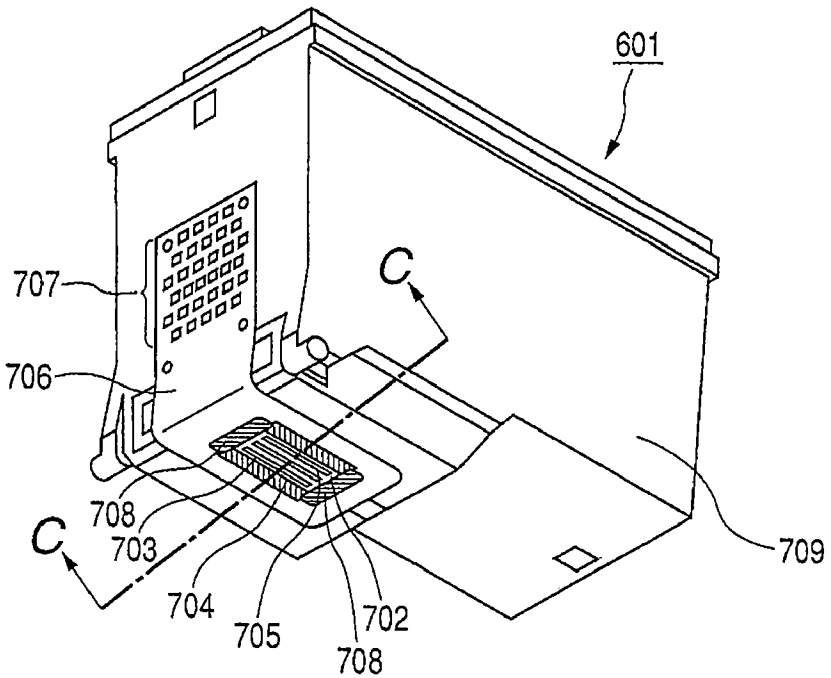
FIG. 9A PRIOR ART
Figure 10:
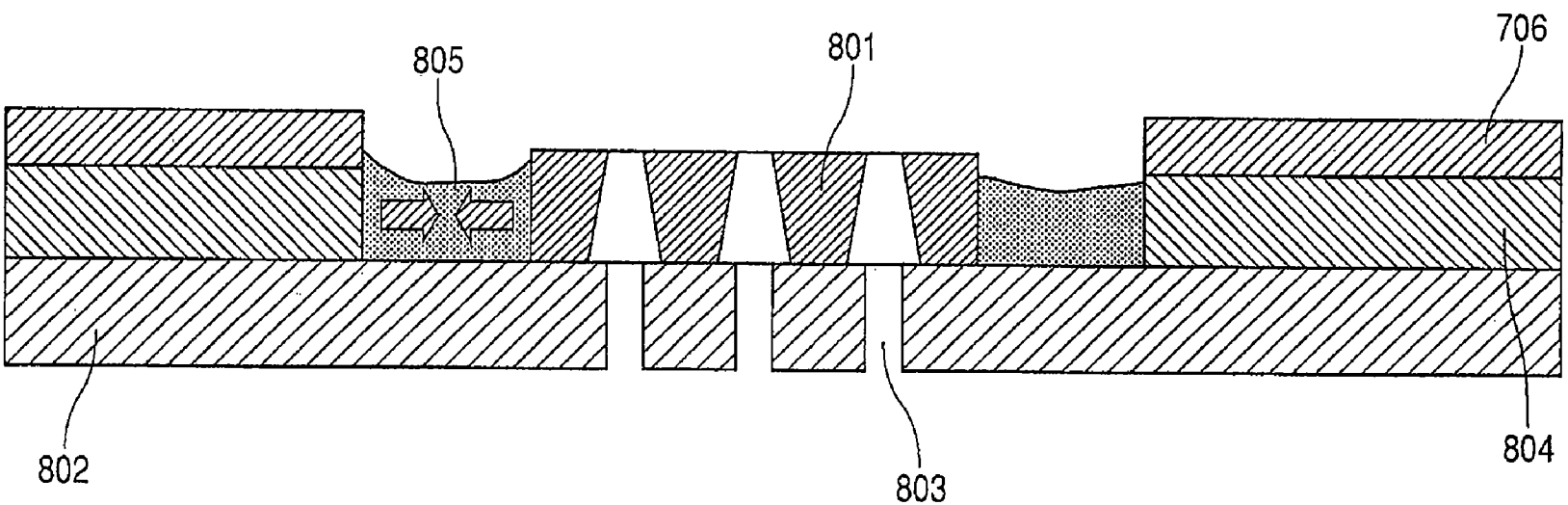
FIG. 10 PRIOR ART
FIG. 10 is a cross-sectional view along a line C-C in FIG. 9A.

In the following, a liquid discharge apparatus capable of mounting the above-described ink jet head (ink jet recording apparatus or ink jet printer) will be described. FIG. 8 is an explanatory view illustrating an example of an ink jet recording apparatus, in which an ink jet head, embodying the present invention, can be mounted.

In the ink jet recording apparatus illustrated in FIG. 8, an ink jet head cartridge 602 according to the foregoing exemplary embodiments is replaceably mounted on a carriage 603. The ink jet head cartridge 602 is to discharge color inks of yellow, magenta and cyan colors, and, alongside the ink jet head cartridge, a black cartridge for discharging a black ink is mounted.

The carriage 603 is equipped with an electrical connecting portion (not illustrated) for transmitting drive signals to the discharge port arrays through the electrical wiring tape of the ink jet head cartridge 602.

The carriage 603 is so supported and guided as to be capable of a reciprocating motion, along a guide shaft 604, extending in a main scanning direction in a main body of the apparatus.

In a home position of the carriage, a cap member (not illustrated) is provided for covering a front face, bearing the ink discharge ports, of the ink jet head cartridge 602. The cap member is used for executing a suction recovery operation, for recovering the ink discharge performance of the ink jet head cartridge 602. In the vicinity of the cap member, a cleaning blade (not illustrated) is provided for rubbing a face, where the ink discharge ports are opened, of the ink jet head cartridge 602, thereby removing ink, paper dust and the like deposited thereon.

A recording medium 611, such as a recording paper or a thin plastic sheet, is separated and fed one by one from an auto sheet feeder (ASF) 614, and is conveyed through a position (recording position) opposed to the face containing the discharge ports of the ink jet head cartridge 602.

The ink jet head cartridge 602 is mounted on the carriage 603 in such a manner that the direction of array of the discharge ports in the discharge port arrays crosses the scanning direction of the cartridge 603, and inks, as the liquids, are discharged from these discharge port arrays onto the recording medium 611 thereby achieving a recording.

The foregoing exemplary embodiments utilize an electrothermal converting element for generating thermal energy, in order to discharge the ink utilizing the thermal energy, but the present invention may naturally utilize other discharge methods, such as a method of discharging ink by a vibration element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-149903, filed May 30, 2006, which is hereby incorporated by reference herein in its entirety.

What is claimed is:

1. A liquid discharge head comprising:

a liquid discharge substrate including an energy generating element for generating liquid-discharging energy and a liquid discharge port;

a flow path member of a resinous material fixed to the liquid discharge substrate and having at least a liquid supply path for supplying the liquid discharge substrate with a liquid;

a sealing material of a resinous material for sealing a periphery of the liquid discharge substrate;

a concave part formed on the flow path member for accommodating the liquid discharge substrate; and a support substrate which is adhered and fixed to a bottom face of the concave part, which supports and is adhered to a surface of the liquid discharge substrate at a side opposite to the liquid discharge port and which is prepared with a material having a Young's modulus higher than that of at least the liquid discharge substrate and having a linear expansion coefficient lower than that of the flow path member, wherein a distance $L_1$ from a lateral face of the concave part of the flow path member to an end of the support substrate, a distance $L_2$ from the lateral face of the concave part to a lateral face of the liquid discharge substrate, a linear expansion coefficient $E_1$ of the flow path member and a linear expansion coefficient $E_2$ of the sealing material satisfy a relation: $L_1 \times E_1 > L_2 \times E_2$.

2. A liquid discharge head according to claim 1, wherein the sealing material of resinous material is filled in a gap between a lateral face of the concave part of the flow path member and a lateral face of the liquid discharge substrate, and at least two opposed lateral faces of the liquid discharge substrate are subjected to a compression stress by the sealing material.

3. A liquid discharge head according to claim 1, wherein the flow path member is formed of a resin having a linear expansion coefficient higher than that of the liquid discharge substrate.

4. A liquid discharge head according to claim 1, wherein the liquid discharge substrate is formed by utilizing a silicon substrate, and the support substrate is constituted of alumina.

5. A liquid discharge head according to claim 1, wherein the sealing material of resinous material is a thermosetting resin.

6. A liquid discharge head according to claim 1, further comprising:

an electrical wiring member for transmitting an electrical signal to the liquid discharge substrate from an external apparatus; and an electrical connecting portion provided in the vicinity of an end of the liquid discharge substrate for electrically connecting the electrical wiring member, wherein at least the electrical connecting portion of the electrical wiring member is fixed on the support substrate.

7. A liquid discharge head according to claim 1, further comprising:

at least a liquid supply opening, formed in the liquid discharge substrate, for supplying the energy generating element with a liquid;

a liquid supply path provided on the support substrate, corresponding to the liquid supply opening in the liquid discharge substrate; and at least a beam provided in the liquid supply path in the support substrate.

8. A liquid discharge head according to claim 7, wherein the beam of the support substrate is shaped, in at least either of an adhesion surface of the support substrate to the liquid discharge substrate and an adhesion surface of the support substrate to the flow path member, as a concave form recessed from the adhesion surface toward the inside of the liquid supply path.

9. A liquid discharge head according to claim 7, wherein the liquid supply opening in the liquid discharge substrate is provided in an array of at least three units, while the support substrate includes liquid supply paths corresponding to the liquid supply openings in the liquid discharge substrate, and beams are provided only in the liquid supply paths on both sides.

* * * * *